US005370222A

United States Patent [19]

Steigerwald et al.

[11] Patent Number: 5,370,222

[45] Date of Patent: Dec. 6, 1994

[54] ARRANGEMENT FOR MIXING TWO COMPONENTS

[75] Inventors: Franz Steigerwald, Griesheim; Gabriele Bock, Darmstadt; Martina Schmitt, Gernsheim, all of Germany

[73] Assignee: Wella Aktiengesellschaft, Darmstadt, Germany

[21] Appl. No.: 62,125

[22] Filed: May 14, 1993

[30] Foreign Application Priority Data

Jun. 11, 1992 [DE] Germany ..... 94219063

[51] Int. Cl.[5] ..... B65D 25/08

[52] U.S. Cl. ..... 206/222; 206/219; 215/DIG. 8

[58] Field of Search ..... 206/219, 222; 215/6, 215/DIG. 8

[56] References Cited

U.S. PATENT DOCUMENTS

| | | | |
|---|---|---|---|
| 2,721,552 | 10/1955 | Nosik | 215/6 |
| 3,415,360 | 12/1968 | Baumann et al. | 206/222 |

FOREIGN PATENT DOCUMENTS

| | | | |
|---|---|---|---|
| 37755 | 7/1973 | Australia | 206/222 |
| 2290366 | 6/1976 | France | 206/219 |
| 2453793 | 12/1980 | France | 206/222 |
| 2432290 | 1/1976 | Germany | 206/222 |
| 3924152 | 12/1990 | Germany . | |
| 573376 | 2/1958 | Italy | 215/6 |
| 2220930 | 1/1990 | United Kingdom | 206/222 |

*Primary Examiner*—William I. Price
*Attorney, Agent, or Firm*—Michael J. Striker

[57] ABSTRACT

An arrangement for mixing two components comprises a container having a first engaging formation, a closing element having a second engaging formations cooperating with the first engaging formation when the closing element is screwed onto the container, and a removable receptacle releasably connectable with the closure element and having a foil which faces an interior of the container when the closure element is screwed onto the container, and is removable in an assembled condition so as to release a content of the receptacle into the interior of the container.

7 Claims, 5 Drawing Sheets

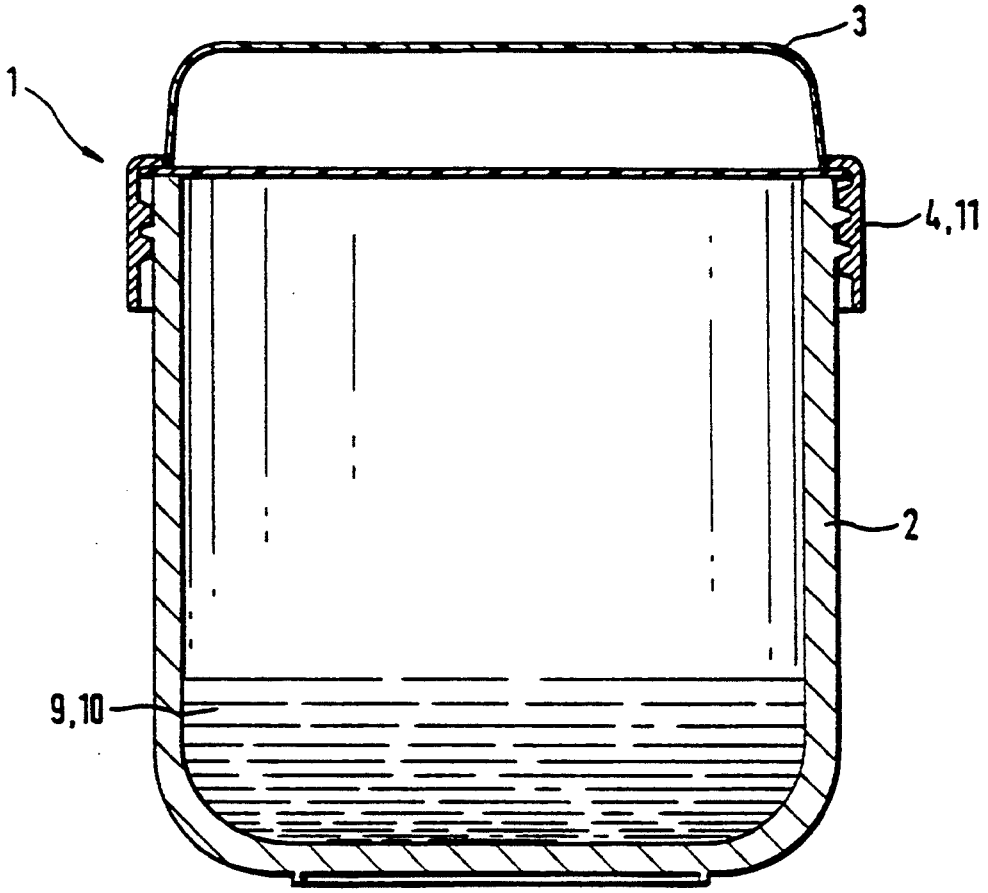
Fig.5
Fig.6
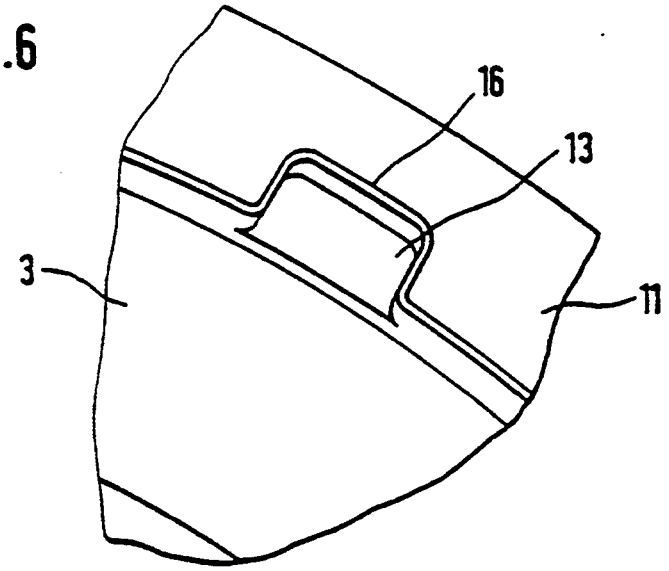

ARRANGEMENT FOR MIXING TWO COMPONENTS

BACKGROUND OF THE INVENTION

The present invention relates to an arrangement for mixing two components.

More particularly, it relates to an arrangement for mixing two components which includes a container with a screw thread and a screw element which is screwable on the container.

Arrangements for mixing two components, including a container with a screw thread and a screw element screwable on the container are known in the art in various modifications. For example, caps are known which, due to a screw movement of a screw element on a threaded neck of a container separate the foils inserted in the container.

German document DE-PS 39 24 152 discloses an arrangement in which a screw element is formed as a cap with a tooth which extends in the threaded neck of a container and during a screw movement of the cap separates the foil in the threaded neck. When the foil separates two different components, for example two liquids or a liquid and a powder material, then during the separation of the foil and shaking of the container a mixture of two components is produced.

It is advisable to utilize such arrangements for example for separate preparation of liquid components which must be mixed shortly before their use. A mixture of individual components is prepared after a certain time, for example such as the components including a permanent wave solution and ester for a hair treatment. Such arrangements can be also used for separate preparation of a dust product and a liquid. Due to the solution of the dust product, for example natural hair dye powder, in the liquid a dust generation leads to loading of a user in a short time.

The disadvantage of the known arrangements is that they are not suitable for at least partial repeated use. They have relatively expensive constructions and therefore are expensive to manufacture. After destruction of a foil which separates the components, a user cannot restore the operability of the arrangement.

SUMMARY OF THE INVENTION

Accordingly, it is an object of the present invention to provide an arrangement for mixing two components, which avoids the above mentioned disadvantages of the prior art.

More particularly, it is an object of the present invention to provide an arrangement for mixing two components, which is designed so that its operability can be restored by a user without problems.

In keeping with these objects and with others which will become apparent hereinafter, one feature of the present invention resides, briefly stated, in an arrangement for mixing two components having a container with a screw thread and a screw element which is screwable on the container wherein in accordance with the present invention in the region of an upper edge of the open container at least one cutting mandrel is provided, the screw element which is screwable on the container has a releasable receptacle with a foil which can be cut by the cutting mandrel, and the lower inner diameter of the receptacle is greater than the double distance between the central axis of the container and the cutting mandrel.

When the arrangement is designed in accordance with the present invention, it avoids the disadvantages of the prior art and provides for the above mentioned highly advantageous results.

The receptacle is placed in the screw element and subsequently the screw element is screwed on the container. During placing of the screw element on the container the cutting mandrel arranged on the upper edge of the container pierces through the foil of the receptacle. During the turning of the screw element on the screw thread of the container the foil is cut along a circle. Thereby, a product component which is contained in the receptacle falls into the container to be mixed with a second component accommodated in the container. The whole device for mixing of the product components is closed hermetically. The mixing of both product components can be improved by shaking the arrangement.

In accordance with another advantageous feature of the present invention the foil which is provided in the receptacle and faces the container is a water soluble foil. The water soluble foil of the receptacle is dissolved by an aqueous solution in the container. For this purpose the closed receptacle is turned so that the foil is brought in contact with the solution.

The arrangement in accordance with the present invention has a relatively simple construction and is manufactured in a cost favorable manner. The container and the screw element can be produced by injection molding, while the receptacle can be produced by deep drawing. The foil for the receptacle can be connected with the container for example by heat sealing. The container and the screw element after their cleaning can be provided with a new receptacle. The restoring of the operability of the arrangement can be achieved by a user in a simple manner, so that instead of emptied receptacle a new, filled receptacle must be inserted in the screw element.

A thread abutment in the container for a cutting path of the cutting mandrel through the foil can substantially correspond to somewhat more than three-thirds of a circle. In this case the foil is not completely separated from the receptacle and does not fall into the container in which the product components are to be mixed.

The screw element can be provided with driving cams while the receptacle can be provided with driving recesses or vice versa. In this construction during screwing of the screw element the receptacle is turned together with it, and the cutting mandrel cuts through the foil. Slippage between the screw element and the receptacle is thereby prevented.

The foil can be composed of a synthetic plastic-coated aluminum foil. When such a foil separates both components, the aluminum layer provides high barrier properties with respect to a product diffusion while the synthetic plastic coating (for example, the same synthetic plastic as in the receptacle) can be easily hot sealed with the edge of the receptacle.

An especially simple handling of the inventive device is obtained when the receptacle is clamped in the screw element in a form-locking manner. An emptied receptacle can be pulled out from the screw element and a new receptacle can be pushed into the screw element.

A seal can be provided on the edge of the receptacle. In this construction during screwing of the screw element the edge of the receptacle is pressed against the seal and thereby the inner chamber of the container is hermetically closed. Also, during a shaking or turning of the assembled arrangement, no liquid can escape from it.

The receptacle can be manufactured in an especially cost-favorable manner when it is composed of a deep drawn synthetic plastic material.

The screw element can be formed as a threaded ring. With this construction receptacles of different heights can be inserted into the screw element. The individual receptacles extend to a different height from the threaded ring. Receptacles having different heights serve for accommodation of different volumes of the components and thereby providing different mixing ratios in the arrangement.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 5 is a view showing a vertical section of the arrangement of FIG. 4 in assembled condition, after dissolving of the water soluble foil; and FIG. 6 is a view showing a detail of FIG. 3 on an enlarged scale.

DESCRIPTION OF THE PREFERRED EMBODIMENTS

Figure 1:
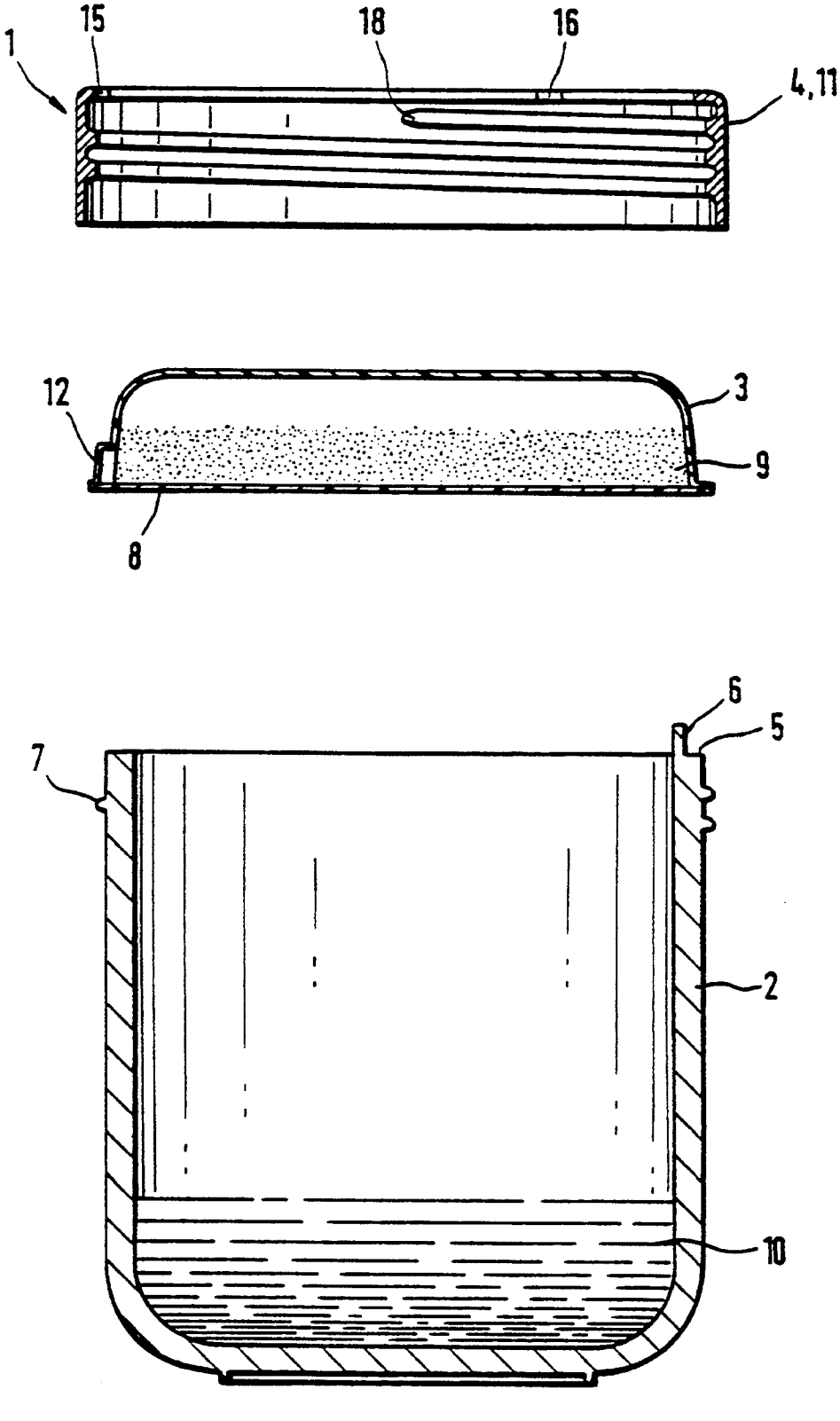
FIG. 1 is a view showing a vertical section of an arrangement in accordance with the present invention in loose condition, including an open container with a screw thread and a cutting mandrel, a receptacle, and a threaded ring.

An arrangement for mixing two components in accordance with the present invention is identified as a whole with reference numeral 1. The arrangement has an open container 2, a receptacle 3, and a screw element 4 which are shown in FIG. 1. A cutting mandrel 6 is provided on an upper edge 5 of the container 2. The upper region of the container 2 has an outer thread 7. The receptacle 3 is closed with a foil 8. The receptacle 3 accommodates a powder component 9.

The container 2 accommodates a liquid component 10. A mixing of the powder component 9 with the liquid component 10 is performed in the container 2 so as to produce a ready to use solution. It can be seen that the screw element 4 is formed as a threaded ring 11.

Figure 2:
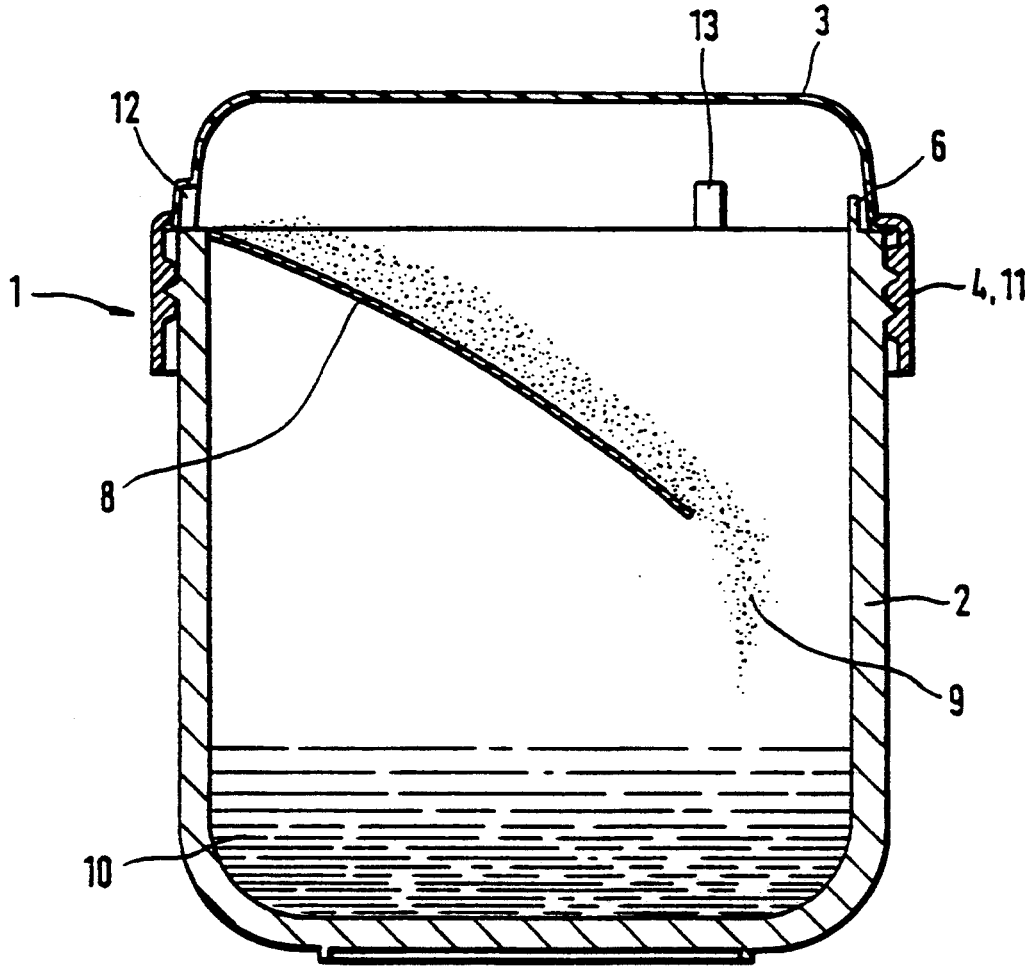
FIG. 2 is a view showing a vertical section of the arrangement of FIG. 1 in the assembled condition.
Figure 3:
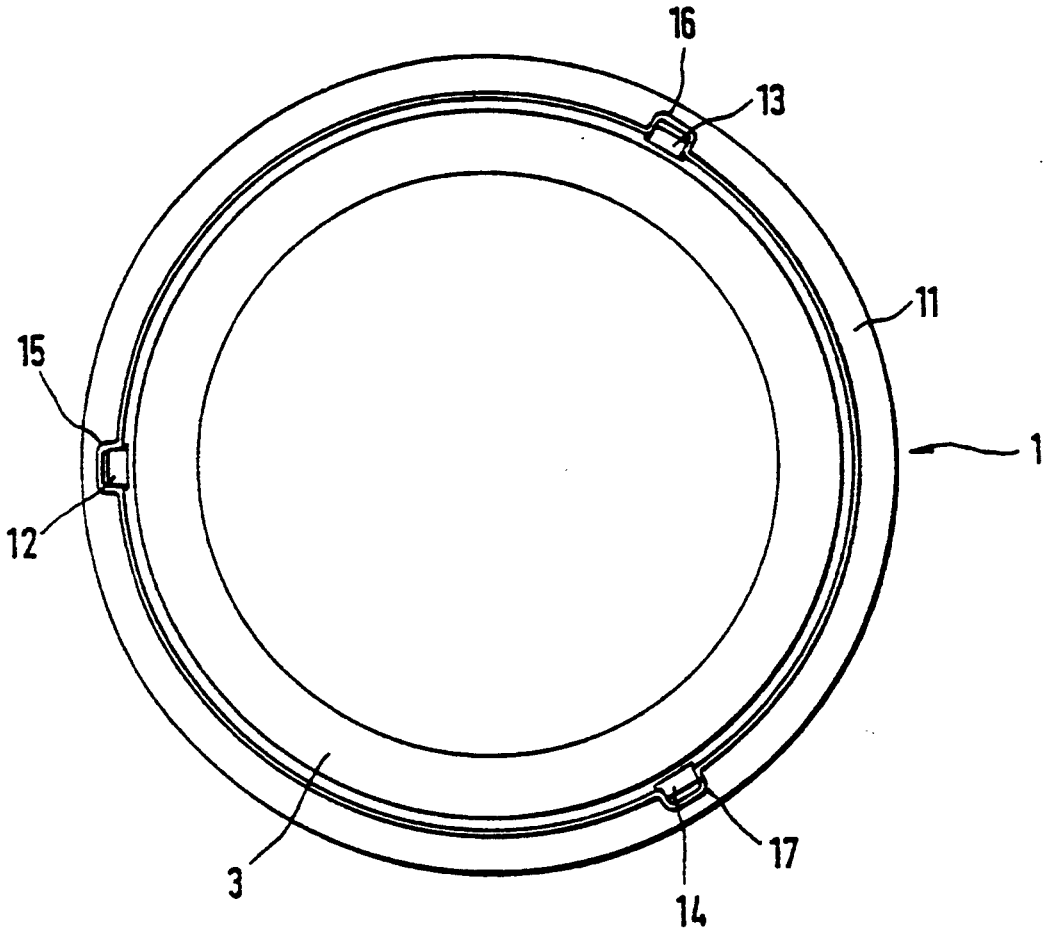
FIG. 3 is a plan view of the arrangement of FIG. 2 in accordance with the present invention.

In order to introduce the powder component 9 into the liquid component 10, first the receptacle 3 which accommodates the powder component 9 is inserted into the threaded ring 11. The receptacle 3 is provided with three driver projections or cams 12, 13, 14 while the threaded ring 11 is provided with three driver recesses 15, 16, 17, as can be seen from FIGS. 1, 2, 3 and 6. During insertion of the receptacle 3 in the threaded ring 11, the driver cams 12, 13, 14 engage in the driver recesses 15, 16, 17. Then the threaded ring 11 is screwed with its inner thread 18 on the outer thread 7 of the container 2. During screwing the cutting mandrel 6 circularly cuts the foil 8 and the powder component 9 falls into the liquid component 10 as can be seen from FIG. 2.

Figure 4:
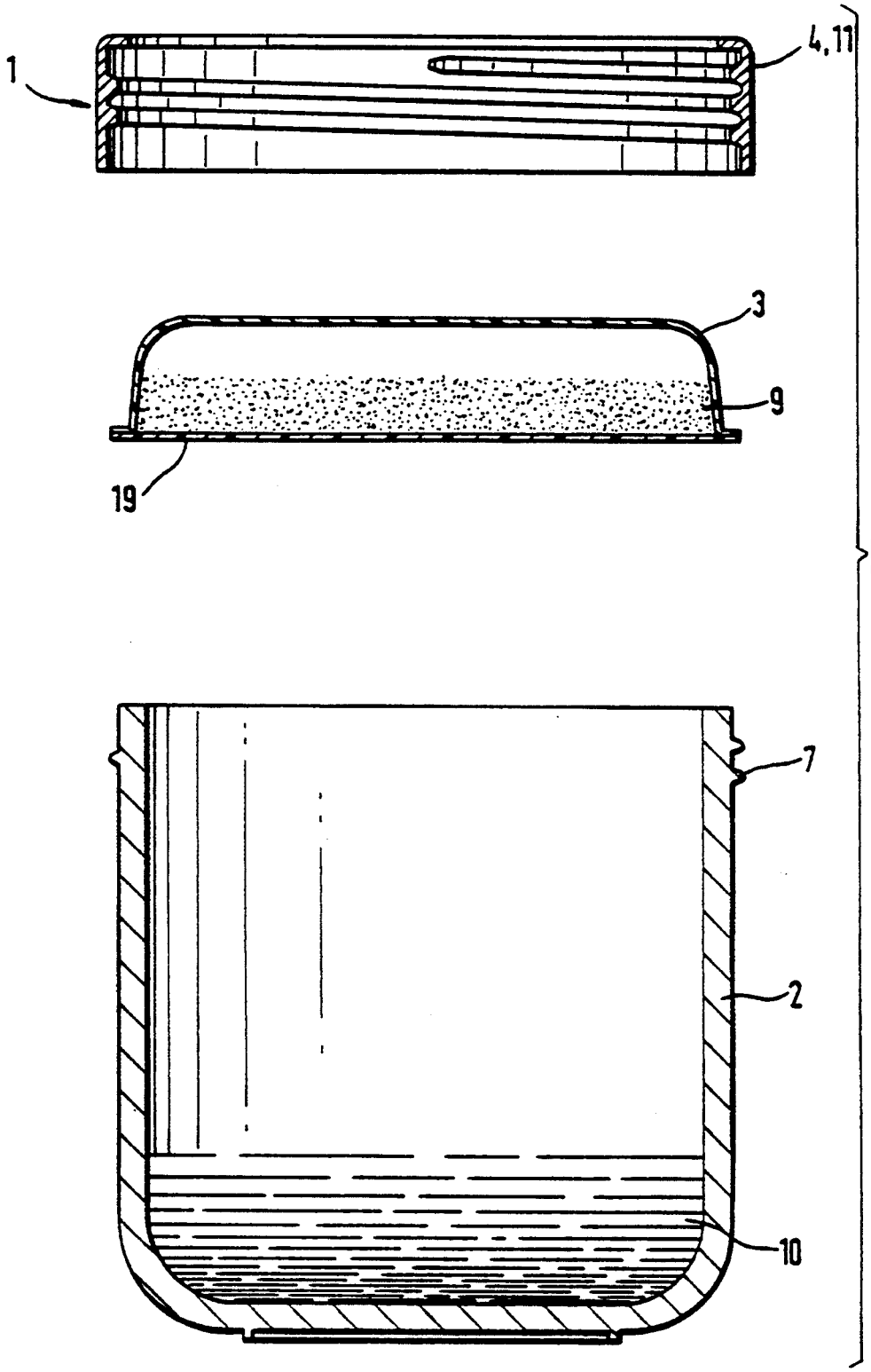
FIG. 4 is a view showing a vertical section of an arrangement in a loose condition, including an open container with a screw thread, a receptacle with a water soluble foil and a threaded ring.

In accordance with another embodiment of the present invention which is shown in FIG. 4, the receptacle is closed by a water soluble foil 19. As for the container 2 it has no cutting mandrel. The arrangement is assembled in the same manner as the arrangement of the first embodiment described hereinabove. After screwing together, the arrangement is shaken. As a result the liquid component 10 moistens the water soluble foil 19 and dissolve the foil. When the foil is dissolved the powder component 9 falls into the container 2 with the liquid component 10 and is dissolved in it as can be seen from FIG. 5.

It is of course to be understood that some modifications are possible. For example, the container and the screw element can be connectable with one another not necessarily by screw threads, but also by other interengaging elements, for example bayonet locks, projections and grooves, etc.

It will be understood that each of the elements described above, or two or more together, may also find a useful application in other types of constructions differing from the types described above.

While the invention has been illustrated and described as embodied in an arrangement for mixing two components, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. An arrangement for mixing two components, comprising a container having a first engaging formation; a closing element having a second engaging formations cooperating with said first engaging formation when said closing element is moved onto said container; a removable receptacle releasably connectable with said closure element and having a foil which faces an interior of said container when said closure element is moved onto said container, said foil being removable in an assembled condition so as to release a content of said receptacle into the interior of said container; and means for removing said foil during screwing of said closure element onto said container, said removing means including a cutting member provided on an edge of said container which faces said closure in the assembled condition.

2. An arrangement as defined in claim 1, wherein said formations on said container and said closure element are formed as cooperating threads.

3. An arrangement as defined in claim 1, wherein said closure is screwable on said container over a path of substantially three-fourth of a circle so that said cutting member does not cut said foil completely from said receptacle.

4. An arrangement for mixing two components, comprising a container having a first engaging formation; a closing element having a second engaging formations cooperating with said first engaging formation when said closing element is moved onto said container; a removable receptacle releasably connectable with said closure element and having a foil which faces an interior of said container when said closure element is moved onto said container, said foil being removable in an assembled condition so as to release a content of said receptacle into the interior of said container; and means for guiding said closure and said receptacle relative to one another, said guiding means including driver cams and driver recesses cooperating with one another.

5. An arrangement as defined in claim 4, wherein said driver cams are provided on said closure, while said driver recesses are provided in said receptacle.

6. An arrangement as defined in claim 4, wherein said closure is provided with said driver recesses, while said receptacle is provided with said driver cams.

7. An arrangement as defined in claim 1, wherein said foil has a synthetic plastic coating facing said closure and an aluminum layer facing an interior of said receptacle.

* * * * *